US008497811B2

(12) United States Patent
Huang

(10) Patent No.: US 8,497,811 B2
(45) Date of Patent: Jul. 30, 2013

(54) PRINTED DUAL-BAND ANTENNA FOR ELECTRONIC DEVICE

(75) Inventor: Hsiao-Ting Huang, Taichung County (TW)

(73) Assignee: Ralink Technology Corp., Jhuei, Hsinchu County (TW)

( * ) Notice: Subject to any disclaimer, the term of this patent is extended or adjusted under 35 U.S.C. 154(b) by 362 days.

(21) Appl. No.: 12/895,803

(22) Filed: Sep. 30, 2010

(65) Prior Publication Data

US 2011/0115687 A1 May 19, 2011

(51) Int. Cl.
*H01Q 11/00* (2006.01)

(52) U.S. Cl.
USPC ..... 343/843; 343/893; 343/853; 343/810

(58) Field of Classification Search
None
See application file for complete search history.

(56) References Cited

U.S. PATENT DOCUMENTS

| | | | | |
|---|---|---|---|---|
| 7,053,856 | B2 * | 5/2006 | O'Sullivan | 343/866 |
| 2007/0236400 | A1 * | 10/2007 | Rentz | 343/753 |
| 2007/0285334 | A1 * | 12/2007 | Tsutsumi et al. | 343/893 |
| 2011/0291895 | A1 * | 12/2011 | Zaila et al. | 343/702 |

* cited by examiner

*Primary Examiner* — Trinh Dinh
(74) *Attorney, Agent, or Firm* — Winston Hsu; Scott Margo

(57) ABSTRACT

A printed dual-band antenna for an electronic device includes a substrate, a first monopole antenna and a grounding metal sheet. The first monopole antenna is formed on the substrate, and has an electrical length approximating to a quarter wavelength of a first frequency band and a three quarter wavelength of a second frequency band. The grounding metal sheet is formed on the substrate to be a ground of the first monopole antenna. A feeding terminal of the first monopole antenna, formed at a first side of the grounding metal sheet, divides the first side into a first edge and a second edge. Lengths of the first edge and the second edge approximate to a quarter wavelength of the second frequency band.

11 Claims, 13 Drawing Sheets

PRINTED DUAL-BAND ANTENNA FOR ELECTRONIC DEVICE

BACKGROUND OF THE INVENTION

Related Applications

This application claims priority under 35 U.S.C. §119 from TAIWAN 098138660 filed on Nov. 13, 2009, the contents of which are incorporated herein by references.

1. Field of the Invention

The present invention relates to a printed dual-band antenna for an electronic device, and more particularly, to a printed dual-band antenna realized by a monopole antenna having a length approximating to a quarter wavelength of a low frequency band and a three quarter wavelength of a high frequency band.

2. Description of the Prior Art

An electronic product with a wireless communication function, such as a WLAN USB Dongle, transmits or receives radio signals through an antenna to access a wireless network. Therefore, for facilitating the wireless network access, an ideal antenna should have a wide bandwidth and a small size to meet the trends of compact electronic products.

In addition, with advancement of wireless communication technologies, the number of antennas equipped for the electronic product is increased. For example, a multi-input multi-output (MIMO) communication technology is supported by IEEE 802.11n. That is, a related electronic product can simultaneously transmit and receive radio signals by use of multiple antennas, such that data throughput and transmission distance can be significantly increased without extra bandwidth or power expenditure. Thus, spectral efficiency and transmission rates of the wireless communication system can be enhanced, so as to improve communication quality.

Generally speaking, due to merits such as light weight, small size, and high compatibility with various circuits, a printed antenna is widely used for all kinds of wireless communication products. Conventionally, in order to realize a printed dual-band antenna within limited space of electronic products, a high frequency radiation element and low frequency radiation element of the dual-band antenna are often formed in parallel, whereby radiation resistance of the high frequency radiation element is reduced by the low frequency radiation element. Thus, high frequency antenna characteristics such as bandwidth are deteriorated. Besides, since high frequency signals are attenuated faster than low frequency signals in a substrate and air, if the high frequency radiation element can not provide sufficient radiation efficiency, a radiation distance of the high frequency signals is significantly limited.

On the other hand, if multiple antennas in an electronic device supporting MIMO simultaneously transmit signals, the multiple antennas would interfere with each other, so as to reduce antenna efficiency and limit MIMO function.

SUMMARY OF THE INVENTION

It is therefore an objective of the present invention to provide a printed dual-band antenna for an electronic device.

The present invention discloses a printed dual-band antenna for an electronic device. The printed dual-band antenna includes a substrate, a first monopole antenna and a grounding metal sheet. The first monopole antenna is formed on the substrate, and has an electrical length approximating to a quarter wavelength of a first frequency band and a three quarter wavelength of a second frequency band. The grounding metal sheet is formed on the substrate to be a ground of the first monopole antenna. The first monopole antenna has a feeding terminal formed at a first side of the grounding metal sheet. The feeding terminal divides the first side into a first edge and a second edge. Lengths of the first edge and the second edge approximates to a quarter wavelength of the second frequency band.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
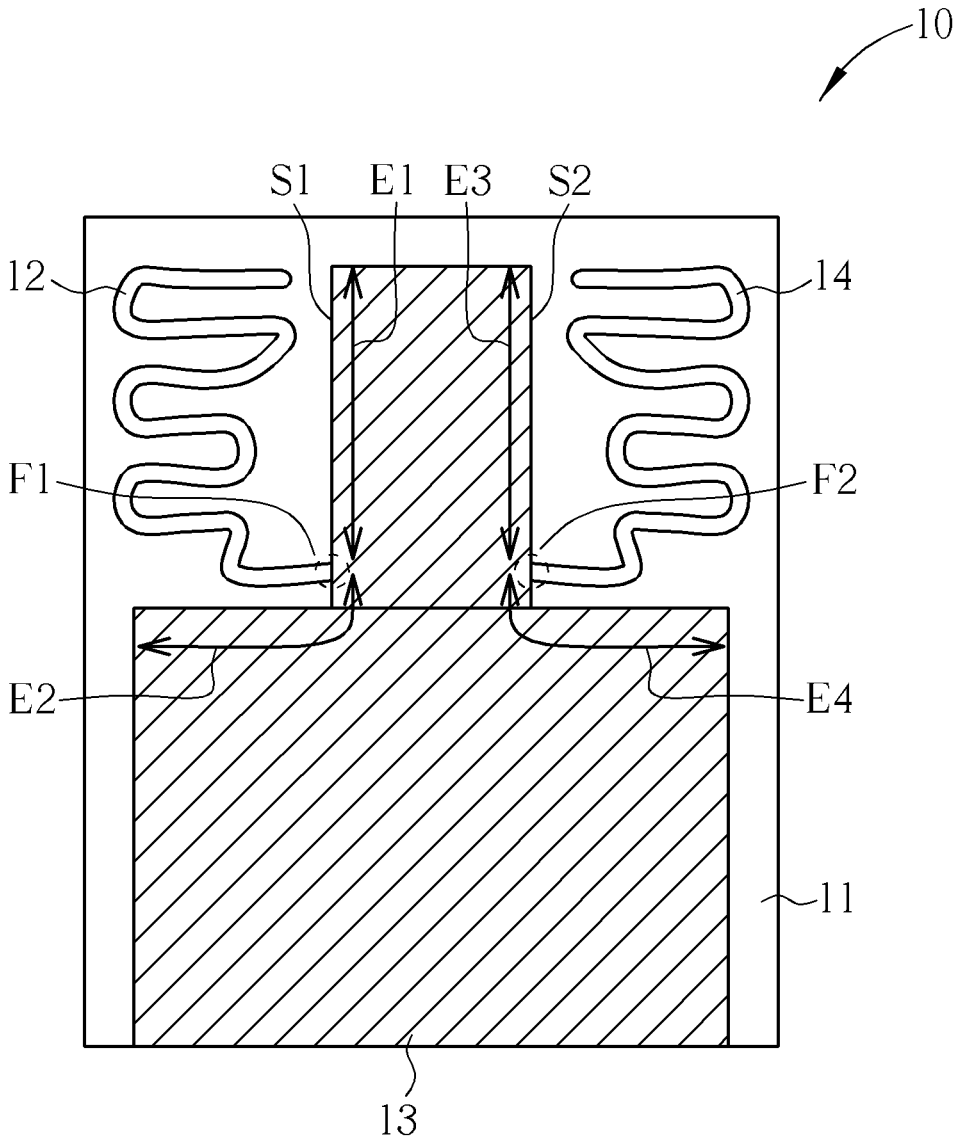
FIG. 1 is a schematic diagram of a printed dual-band antenna according to an embodiment of the present invention.

Please refer to FIG. 1, which is a schematic diagram of a printed dual-band antenna 10 according to an embodiment of the present invention. The printed dual-band antenna 10 is an electronic device for a multi-input multi-output (MIMO) wireless communication system (e.g. IEEE 802.11n), and is utilized for simultaneously transmitting and receiving radio signals. The printed dual-band antenna 10 includes a substrate 11, a monopole antenna 12 and a grounding metal sheet 13. The monopole antenna 12 is a meander-line monopole antenna realized by a metal wire, and is formed on the substrate 11. The monopole antenna 12 has an electrical length approximating to a quarter wavelength of a first frequency band and a three quarter wavelength of a second frequency band. The second frequency band has higher frequency than the first frequency band. The grounding metal sheet 13 is formed on the substrate 11 to be a ground of the monopole antenna 12. The monopole antenna 12 has a feeding terminal F1 formed at a first side S1 of the grounding metal sheet 13. The feeding terminal F1 divides the first side S1 into a first edge E1 and a second edge E2. Lengths of the first edge E1 and the second edge E2 approximate to a quarter wavelength of the second frequency band.

In order to support the MIMO wireless communication system, the printed dual-band antenna 10 further includes a monopole antenna 14. The monopole antenna 14 is also formed on the substrate 11, and has a same structure with the monopole antenna 12. The monopole antenna 14 has a feeding terminal F2 formed at a second side S2 of the grounding metal sheet 13. The feeding terminal F2 divides the second side S2 into a third edge E3 and a fourth edge E4. Lengths of the third edge E3 and the fourth edge E4 approximate to a quarter wavelength of the second frequency band.

As shown in FIG. 1, the first side S1 and the second side S2 are opposite sides of the grounding metal sheet 13, and the first edge E1 is adjacent to the third edge E3. In other words, the two monopole antennas 12 and 14 are on the substrate 11, and are separated by the grounding metal sheet 13 in between. Each monopole antenna has two frequency bands: the first frequency band and the second frequency band, which are corresponding to a low frequency band and a high frequency band, respectively. The electrical length of each monopole antenna approximates to a quarter wavelength of the low frequency band and a three quarter wavelength of the high frequency band. The feeding terminals F1 and F2 divide the two sides S1 and S2 of the grounding metal sheet 13 into two edges, respectively. Length of each edge is substantially a quarter wavelength of the high frequency band. As for design principle of the printed dual-band antenna 10, please refer to the following description.

As known by those skilled in the art, a real part of input impedance of a central-fed half-wavelength dipole antenna is substantially 75 Ω, while a real part of input impedance of a non-central-fed one-wavelength dipole antenna (with a signal line of a three quarter wavelength and a ground line of a quarter wavelength) is close to 100 Ω by simulation. Assume radiation resistance of the antenna is Ra and ohmic loss resistance of the antenna is Rohm, radiation efficiency of the antenna is proportional to Ra/(Ra+Rohm). Since the ohmic loss resistance of the antenna is substantially $10^{-3}$ Ω, according to the aforementioned formula, the greater the radiation resistance is, the higher the radiation efficiency would be. Besides, for a monopole antenna or a dipole antenna, radiation resistance is substantially proportional to a real part of antenna input impedance.

Generally, a printed monopole antenna is close to ground due to substrate size, resulting in that radiation resistance of the antenna is low (~10 Ω). In this case, bandwidth of the antenna will become very narrow after impedance matching. Therefore, if the radiation resistance of the antenna can be initially designed as close to 50 Ω as possible, the bandwidth of the antenna would be significantly increased after impedance matching. In the embodiment of the present invention, since the monopole antenna with the electrical length approximating to a three quarter wavelength of the high frequency band and its ground edges with the electrical length approximating to a quarter wavelength of the high frequency band are similar to the non-central-fed one-wavelength dipole antenna, the radiation resistance of the high frequency band can be increased so as to increase the bandwidth as well.

Besides, the feeding terminals F1 and F2 divide the grounding metal sheet 13 into two edges. The lengths of the ground edges below the feeding terminal F1 and F2 (i.e. the edges E2 and E4) approximate to a quarter wavelength of the high frequency band. When signals are fed at this point, the high frequency band would have a maximum current value and also a maximum bandwidth. Furthermore, the antenna itself has the electrical length approximating to a three quarter wavelength of the high frequency band, thus high frequency band signals can be resonated. Similarly, the lengths of the ground edges above the feeding terminal F1 and F2 (i.e. the edges E1 and E3) approximate to a quarter wavelength of the high frequency band, such that the high frequency band signals can also be resonated. In this case, the edges E1 and E3 act as a reflector, for isolating ground currents of the high frequency band of the two antennas, so as to reduce the amount of current flowing to the adjacent antenna. As a result, the monopole antennas 12 and 14 have great isolation.

Preferably, the embodiment of the present invention can properly adjust the lengths of the edges E1 and E3 to substantially greater than a quarter wavelength of the high frequency band according to impedance matching requirement. As a result, the embodiment of the present invention can further increase the bandwidth of the high frequency band.

Figure 2:
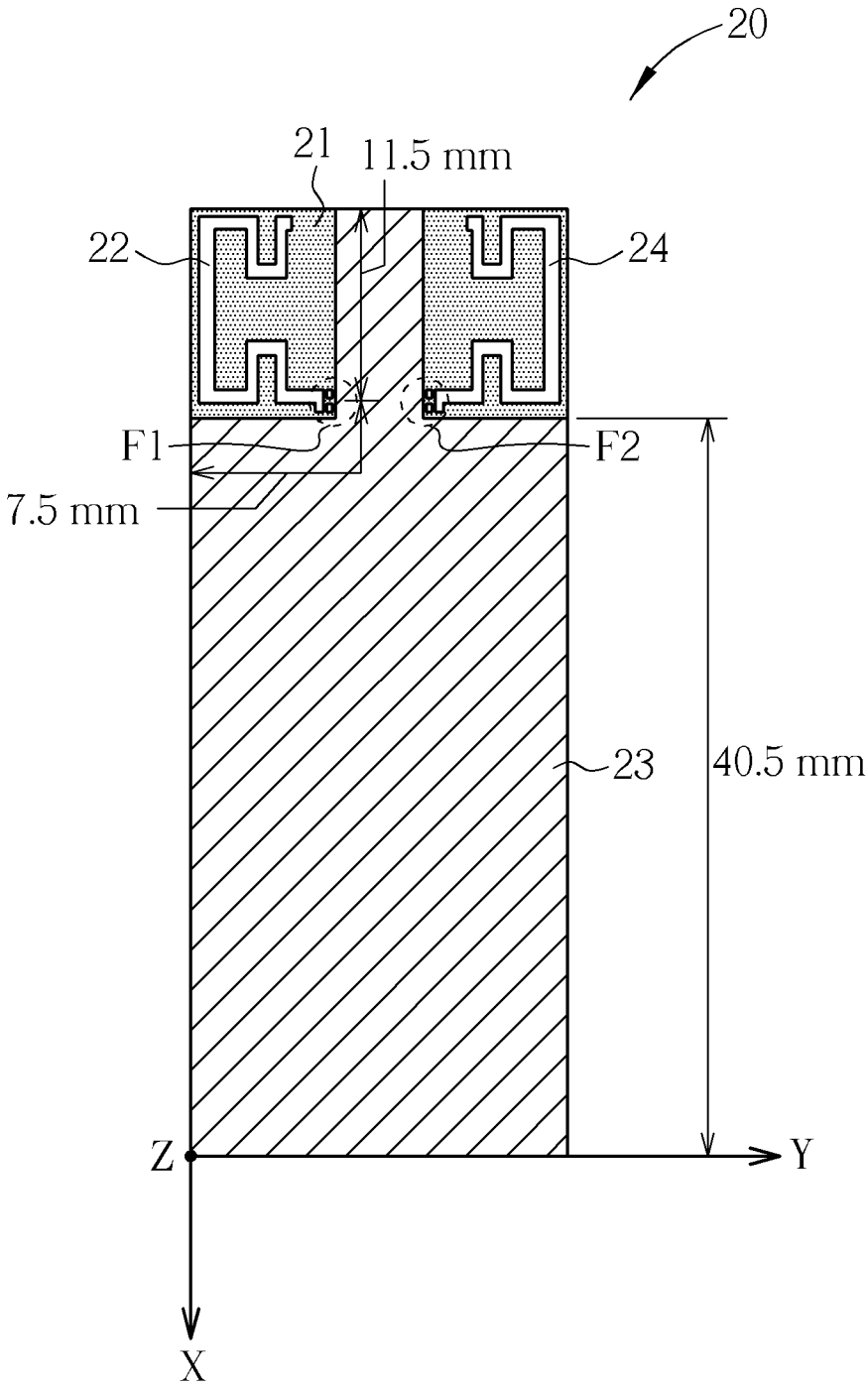
FIG. 2 is a schematic diagram of a printed dual-band antenna according to a preferred embodiment of the present invention.

Please refer to FIG. 2, which is a schematic diagram of a printed dual-band antenna 20 according to a preferred embodiment of the present invention. The printed dual-band antenna 20 has operating frequencies of 2.4 GHz and 5 GHz, and is realized in a WLAN USB dongle supporting IEEE 802.11a/b/g/n standard. As shown in FIG. 2, the printed dual-band antenna 20 includes two monopole antennas 22 and 24. Lengths of the monopole antennas 22 and 24 are substantially a quarter wavelength of 2.45 GHz and a three quarter wavelength of 5.5 GHz. Lengths of ground edges below feeding terminals are a quarter wavelength of 5.5 GHz (7.5 mm), and lengths of ground edges above the feeding terminals are substantially greater than a quarter wavelength of 5 GHz (11 mm).

Figure 3:
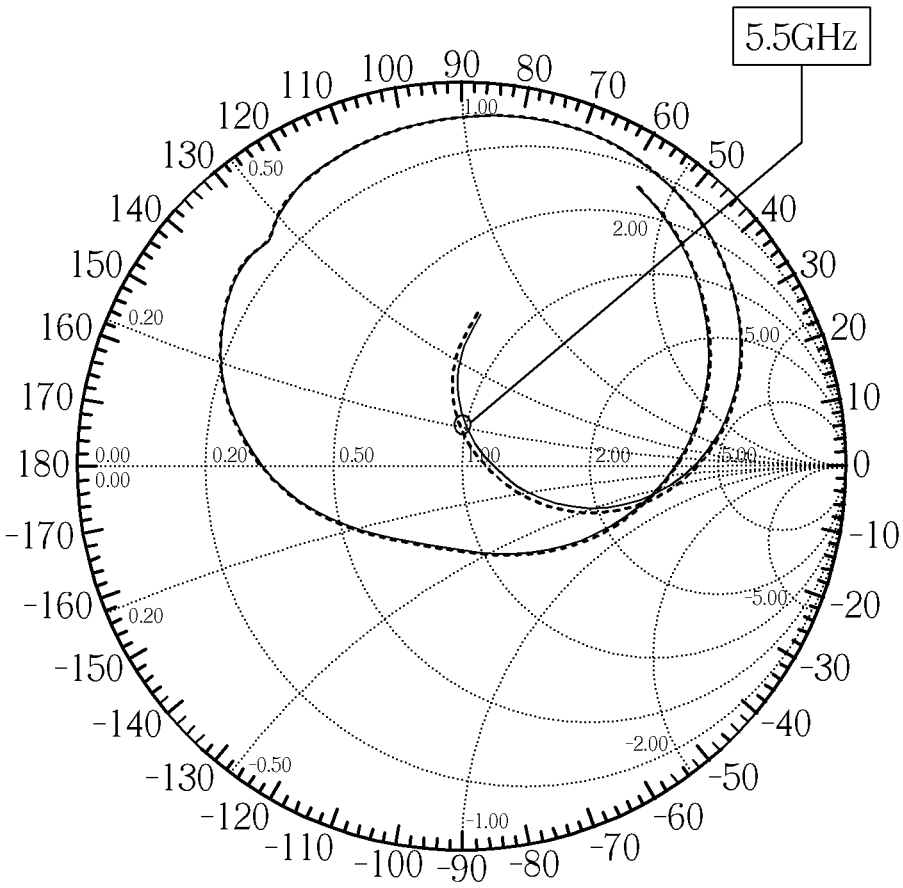
FIG. 3 is a smith chart of the printed dual-band antenna shown in FIG. 2.
Figure 4:
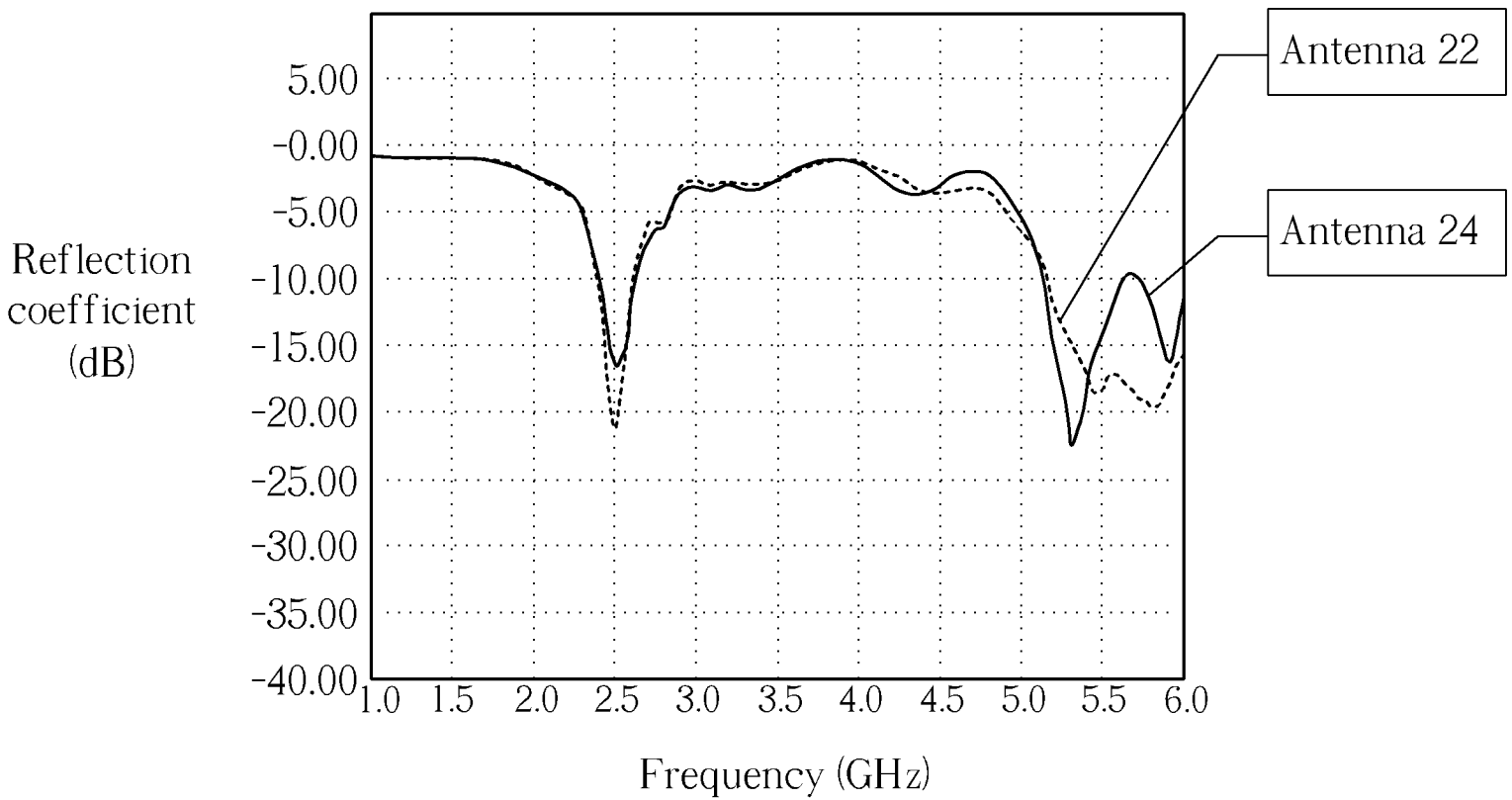
FIG. 4 is a reflection coefficient diagram of the printed dual-band antenna shown in FIG. 2.
Figure 5:
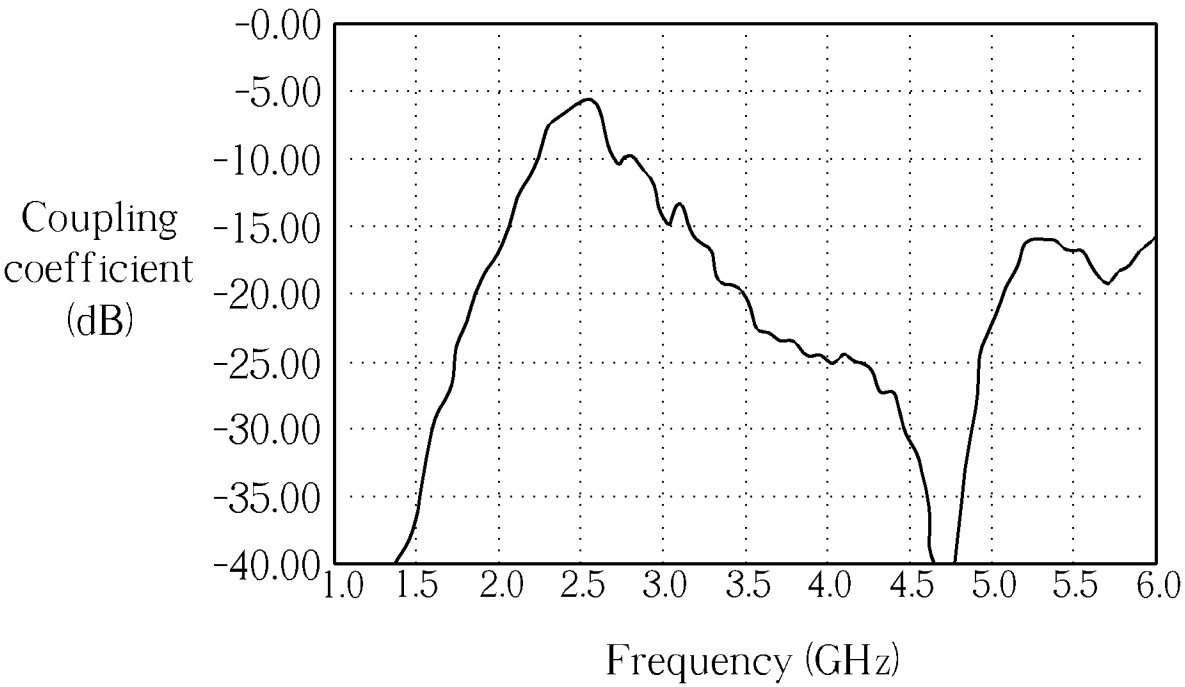
FIG. 5 is a coupling coefficient diagram of the printed dual-band antenna shown in FIG. 2.
Figure 6A:
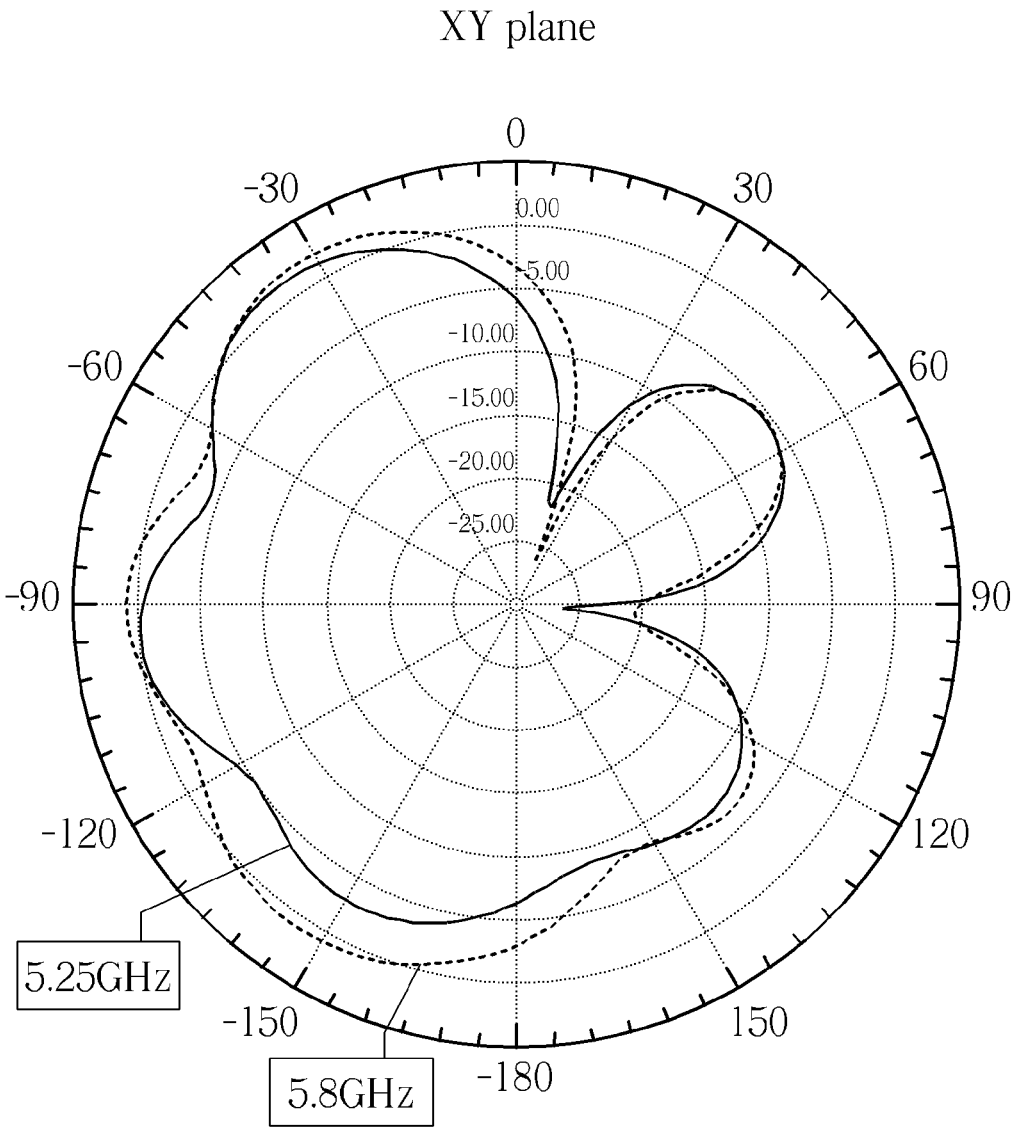
FIG. 6A to FIG. 6C are radiation pattern diagrams of the printed dual-band antenna shown in FIG. 2.
Figure 6B:
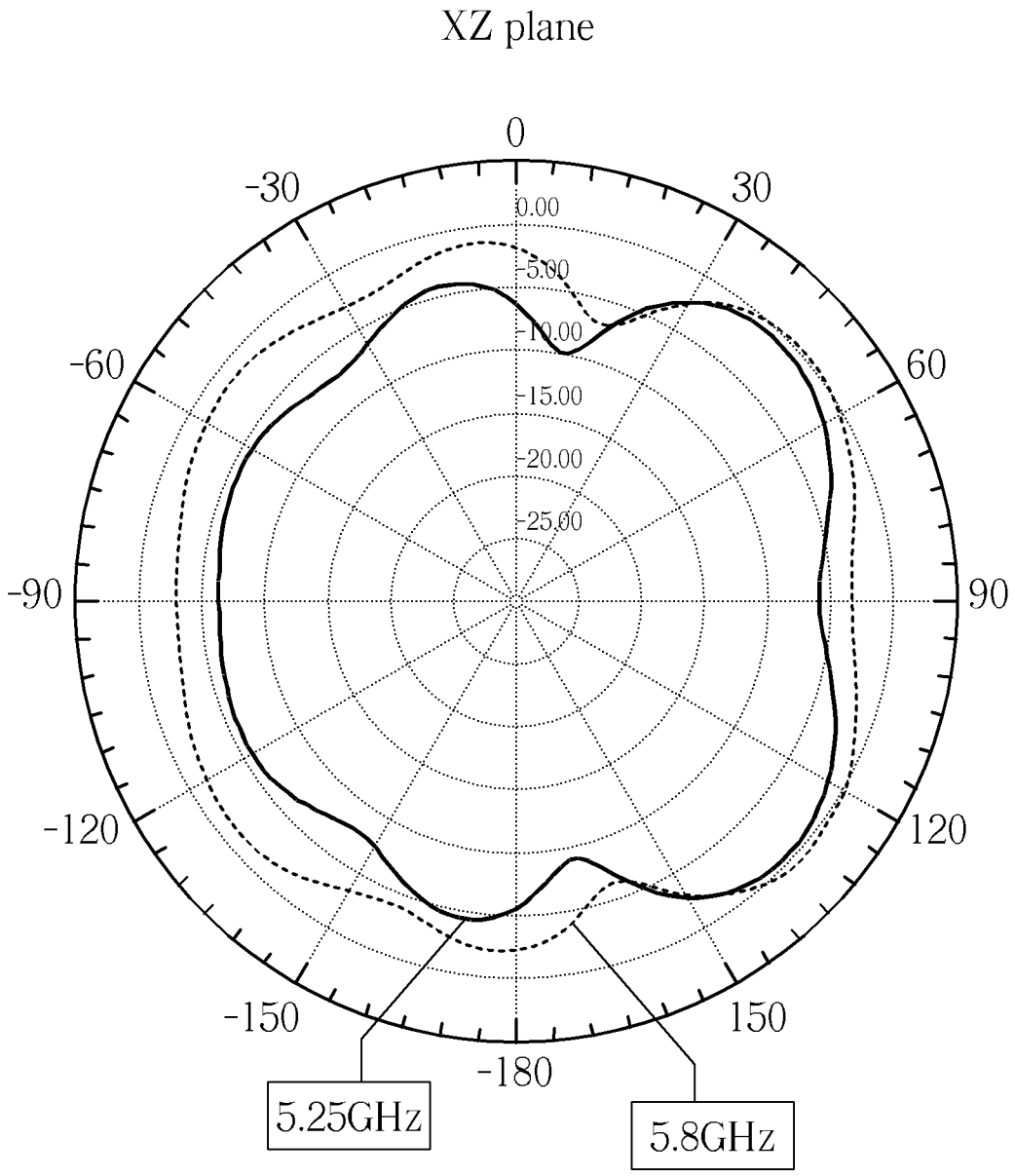
Figure 6C:
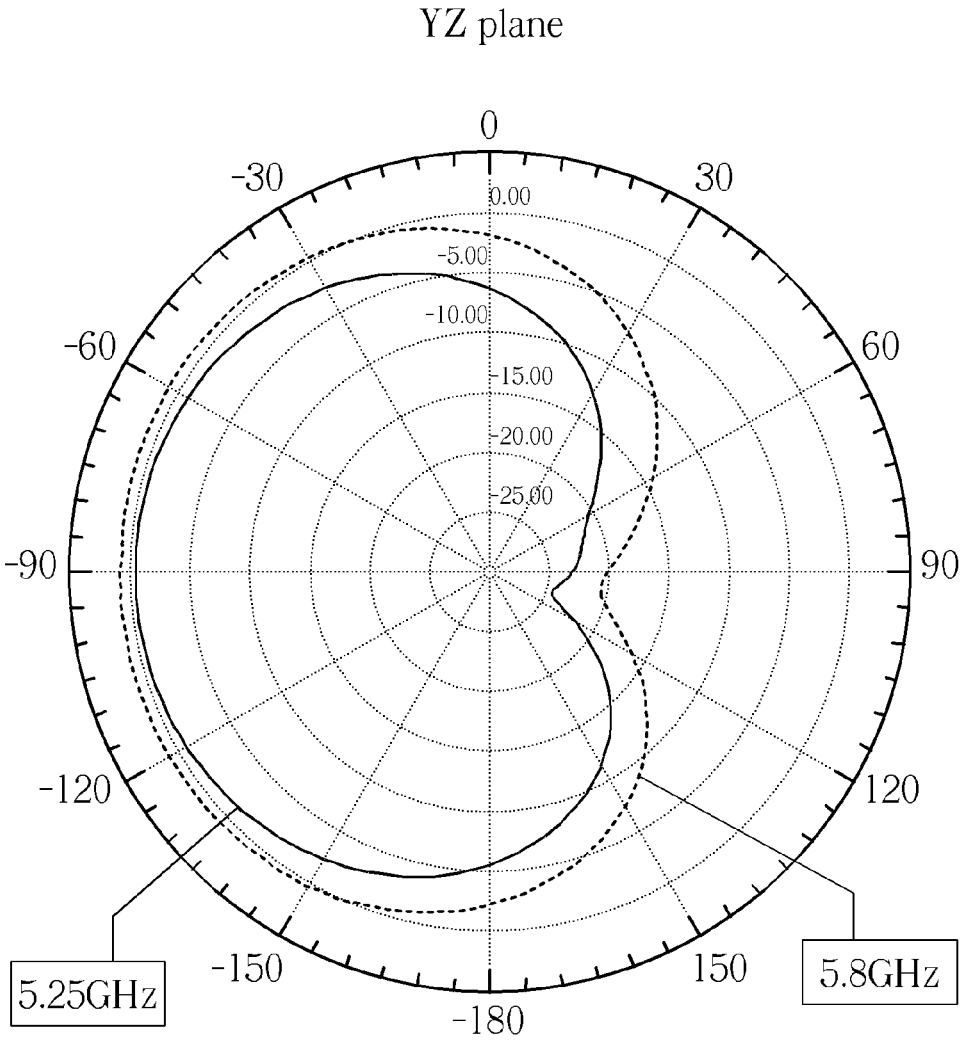
Figure 7:
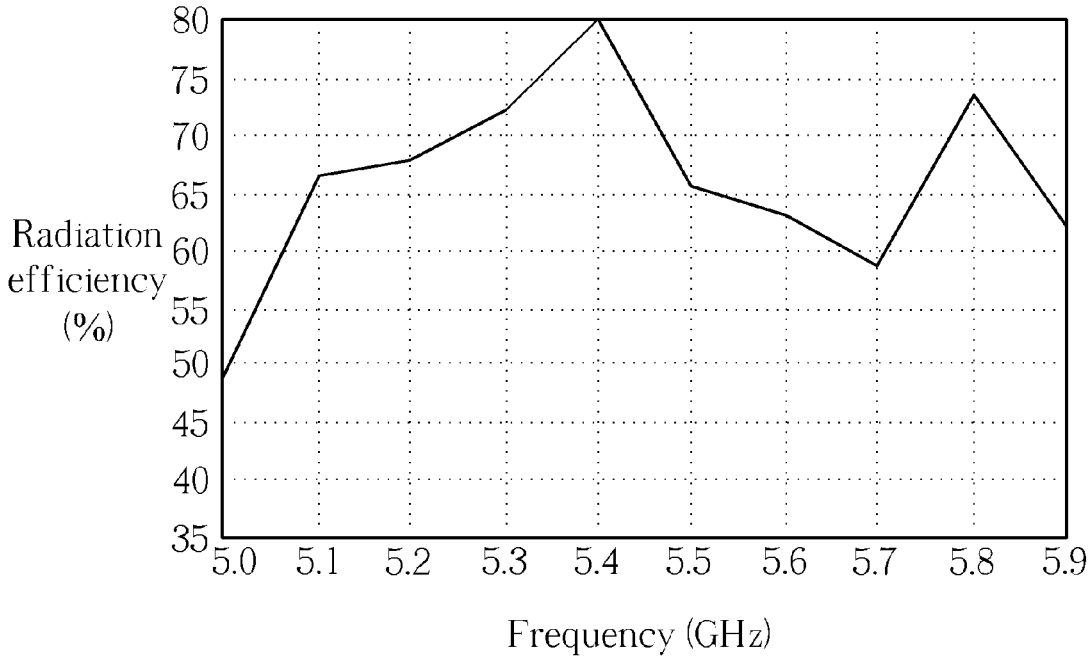
FIG. 7 is a radiation efficiency diagram of the printed dual-band antenna shown in FIG. 2.
Figure 8:
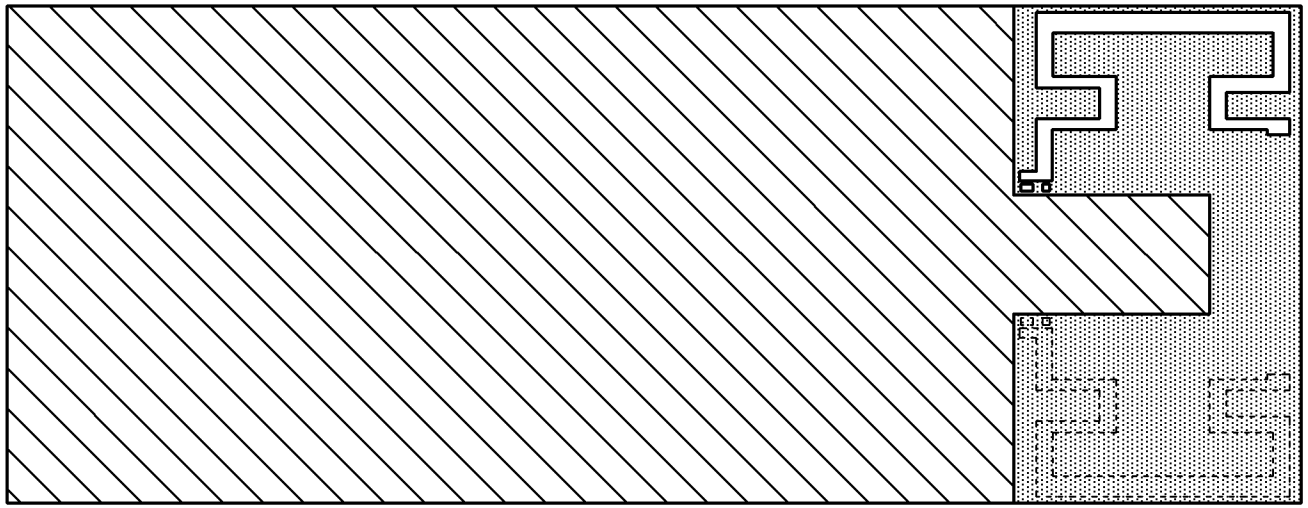
FIG. 8 to FIG. 11 are schematic diagrams of other embodiments of the present invention.
Figure 9:
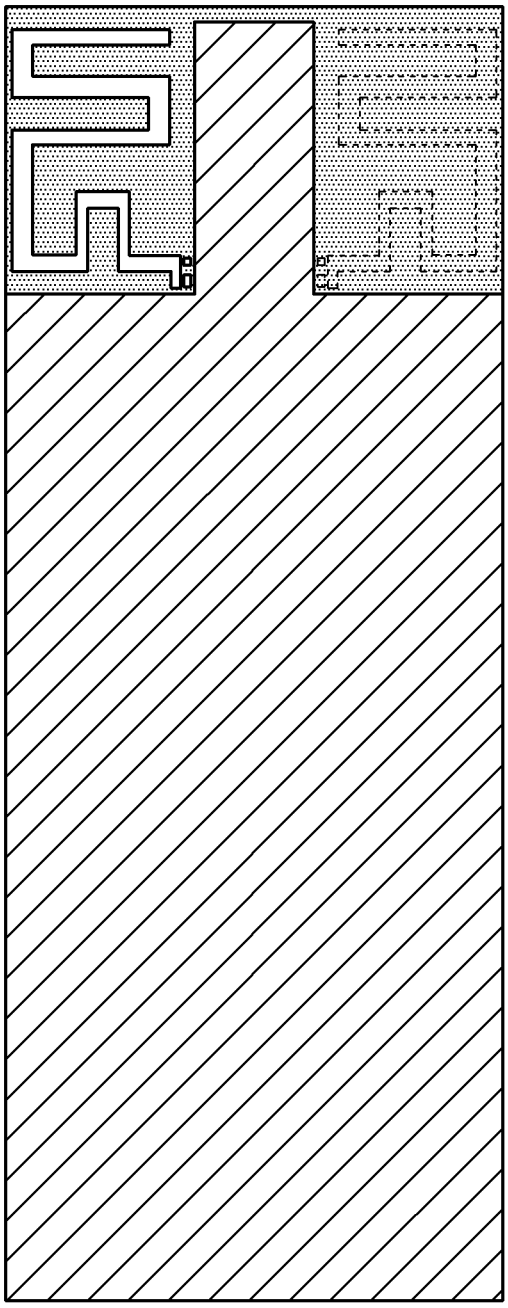
Figure 10:
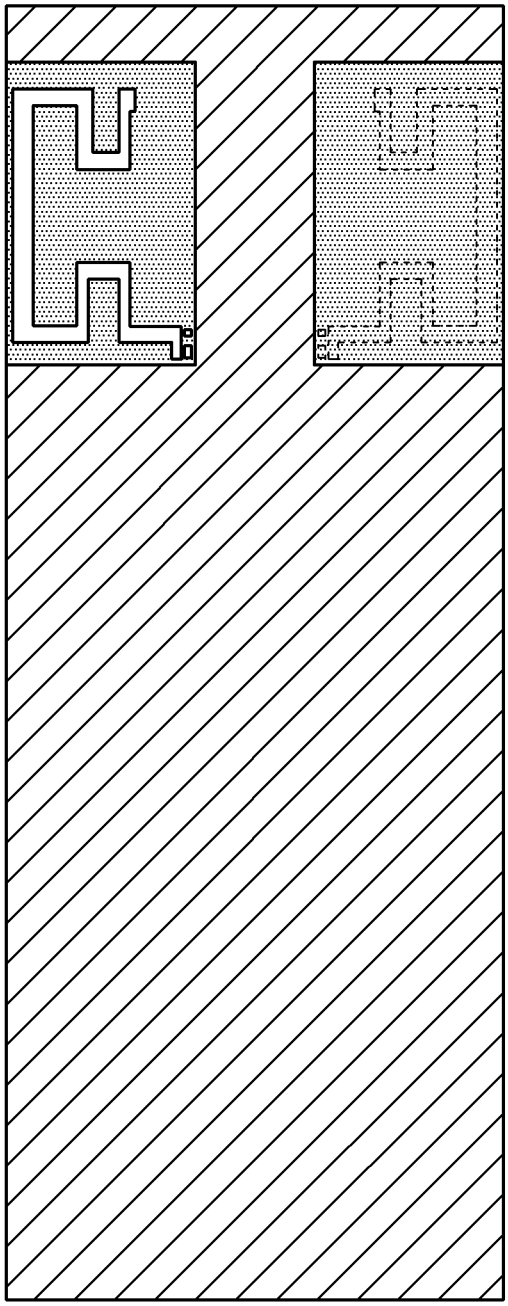
Figure 11:
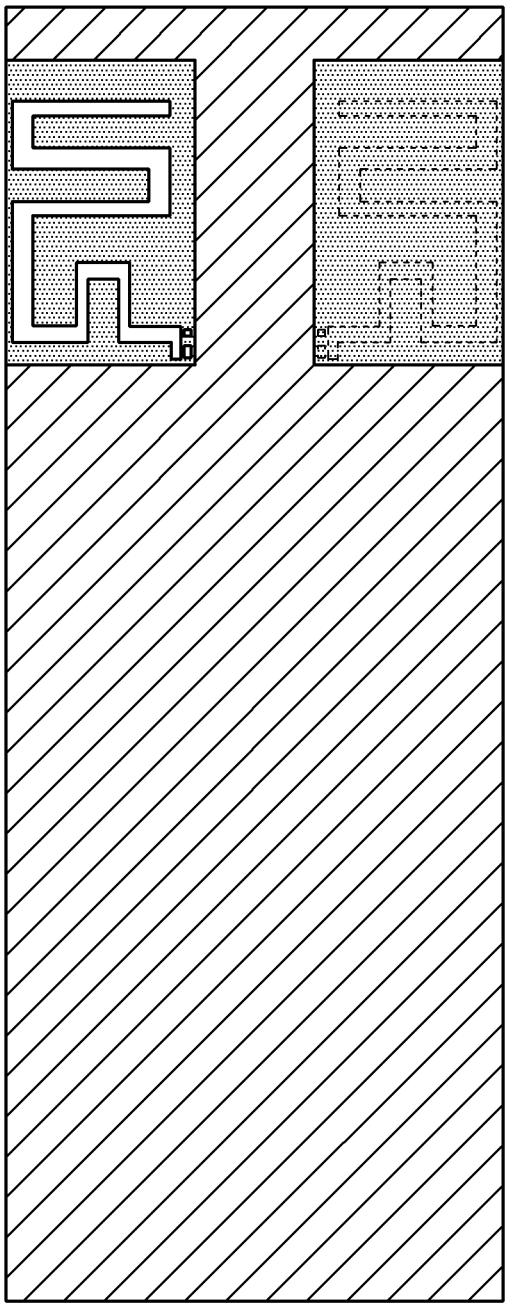

As for simulation results of antenna characteristics of the printed dual-band antenna 20, please refer to FIG. 3 to FIG. 7. FIG. 3 is a smith chart of the printed dual-band antenna 20, FIG. 4 is a reflection coefficient diagram of the printed dual-band antenna 20, FIG. 5 is a coupling coefficient diagram of the printed dual-band antenna 20, FIG. 6A to FIG. 6C are radiation pattern diagrams of the printed dual-band antenna 20, and FIG. 7 is a radiation efficiency diagram of the printed dual-band antenna 20.

As shown in FIG. 3, at high frequency, a real part impedance of the printed dual-band antenna 20 is located around characteristic impedance of a transmission line, thus allowing the high frequency band has a wide bandwidth. FIG. 4 illustrates reflection coefficients of the monopole antennas 22 and 24, respectively. When a criterion is set at −10 dB, the low frequency band of the printed dual-band antenna 20 is substantially between 2.4 GHZ~2.6 GHz, and the high frequency band is substantially between 5.15 GHz~6 GHz.

FIG. 5 illustrates coupling coefficients between the monopole antennas 22 and 24. The coupling coefficients are obtained by measuring or simulating a ratio of energy transmitting from one monopole antenna to another monopole antenna (through electromagnetic coupling) when setting the monopole antenna 22 and the monopole antenna 24 as an input terminal and an output terminal, respectively. Since lengths of the ground edges above the feeding terminals are substantially greater than a quarter wavelength of 5 GHz, coupling coefficients of 5 GHz frequency band are all below −15 dB. Thus, the two adjacent antennas have excellent isolation within the high frequency band.

FIG. 6A to FIG. 6C illustrates radiation pattern diagrams of the monopole antenna 22 on three different cross sections. The radiation fields of the monopole antenna 22 are obtained by simulating interference between the two antennas when the monopole antenna 24 is coupled to a 50Ω load. As shown in FIG. 6A and FIG. 6C, since the ground edges above the feeding terminals reflect the high frequency signals, the radiation fields of the monopole antenna 22 on XY plane and YZ plane are pushed to a 180-270-360 degree half plane, such that the monopole antennas 22 and 24 have excellent isolation. In this case, the printed dual-band antenna 20 can still maintain great radiation efficiency, i.e. the radiation efficiency within the high frequency band is up to 60~80%, as shown in FIG. 7.

Please note that in the embodiment of the present invention, the monopole antennas 22 and 24 are formed on a same side of the substrate. In other embodiments, the monopole antenna 22 and 24 can be formed on an upper side and a lower side of the substrate, respectively, but are not limited to this.

Besides, shapes, sizes or material of the monopole antennas and the grounding metal sheet can be adjusted according to practical requirement, and those modifications belong to the scope of the present invention as long as related electrical lengths retain the spirit of the present invention. FIG. 8 to FIG. 11 are schematic diagrams of other embodiments of the present invention.

To sum up, the present invention provides a printed dual-band antenna for a WLAN USB Dongle, which utilizes the monopole antenna of the electrical length approximating to a quarter wavelength of the low frequency band and a three quarter wavelength of the high frequency band to increase the bandwidth of the high frequency signals. In addition, for multiple antennas with a common ground, positions of the feeding terminals are selected such that isolation, radiation efficiency and bandwidth of the printed dual-band antenna are increased within the high frequency band.

Those skilled in the art will readily observe that numerous modifications and alterations of the device and method may be made while retaining the teachings of the invention.

What is claimed is:

1. A printed dual-band antenna for an electronic device comprising:

a substrate;

a first dual-band monopole antenna, formed on the substrate, providing two electrical lengths approximating to a quarter wavelength of a first frequency band and a three quarter wavelength of a second frequency band respectively; and a grounding metal sheet, formed on the substrate to be a ground of the first monopole antenna;

wherein the first dual-band monopole antenna has a feeding terminal formed at a first side of the grounding metal sheet, the feeding terminal divides the first side into a first edge and a second edge, and both a length of the first edge and a length of the second edge approximate to a quarter wavelength of the second frequency band.

2. The printed dual-band antenna of claim 1, wherein the first dual-band monopole antenna is a meander-line monopole antenna.

3. The printed dual-band antenna of claim 1, wherein the first dual-band monopole antenna is a metal wire.

4. The printed dual-band antenna of claim 1 further comprising a second dual-band monopole antenna, formed on the substrate, having a same structure with the first dual-band monopole antenna, wherein the second dual-band monopole antenna has a feeding terminal formed at a second side of the grounding metal sheet and dividing the second side into a third edge and a fourth edge, both a length of the third edge and a length of the fourth edge approximate to a quarter wavelength of the second frequency band.

5. The printed dual-band antenna of claim 4, wherein the first side and the second side are opposite sides of the grounding metal sheet.

6. The printed dual-band antenna of claim 4, wherein the first edge is adjacent to the third edge.

7. The printed dual-band antenna of claim 4, wherein the first dual-band monopole antenna and the second dual-band monopole antenna are formed on an upper side and a lower side of the substrate, respectively.

8. The printed dual-band antenna of claim 4, wherein the first dual-band monopole antenna and the second dual-band monopole antenna are formed on a same side of the substrate.

9. The printed dual-band antenna of claim 1, wherein the first frequency band and the second frequency band are corresponding to operating frequencies of 2.4 GHz and 5 GHz, respectively.

10. The printed dual-band antenna of claim 1, wherein the electronic device is a WLAN USB dongle.

11. The printed dual-band antenna of claim 1, wherein the electronic device supports a multi-input multi-output (MIMO) wireless communication system.

* * * * *

UNITED STATES PATENT AND TRADEMARK OFFICE

CERTIFICATE OF CORRECTION

PATENT NO. : 8,497,811 B2
APPLICATION NO. : 12/895803
DATED : July 30, 2013
INVENTOR(S) : Hsiao-Ting Huang It is certified that error appears in the above-identified patent and that said Letters Patent is hereby corrected as shown below:

On the title page, item (73), correct the residence of the assignee from "Jhuei, Hsinchu County" to --Jhubei, Hsinchu County--.

On the title page, under item (65), insert item (30) "Foreign Application Priority Data," and add --Nov. 13, 2009 (TW) .....098138660--.

Signed and Sealed this
First Day of October, 2013

Teresa Stanek Rea
*Deputy Director of the United States Patent and Trademark Office*